US009839281B2

(12) United States Patent
Pompliano et al.

(10) Patent No.: US 9,839,281 B2
(45) Date of Patent: Dec. 12, 2017

(54) MULTIFUNCTIONAL GOAL FOR BALL SPORTS, COOLER, AND BACKPACK

(71) Applicants: Brandon Pompliano, Highlands, NJ (US); Nicholas Radice, Belford, NJ (US)

(72) Inventors: Brandon Pompliano, Highlands, NJ (US); Nicholas Radice, Belford, NJ (US)

( * ) Notice: Subject to any disclaimer, the term of this patent is extended or adjusted under 35 U.S.C. 154(b) by 68 days.

(21) Appl. No.: 14/975,096

(22) Filed: Dec. 18, 2015

(65) Prior Publication Data

US 2016/0174693 A1 Jun. 23, 2016

Related U.S. Application Data

(60) Provisional application No. 62/093,764, filed on Dec. 18, 2014.

(51) Int. Cl.

| | |
|---|---|
| ***A45F 4/02*** | (2006.01) |
| ***A63B 63/00*** | (2006.01) |
| ***A45C 11/20*** | (2006.01) |
| ***A45F 3/04*** | (2006.01) |
| ***A63B 47/00*** | (2006.01) |
| *A45C 3/00* | (2006.01) |
| *A45F 3/00* | (2006.01) |

(52) U.S. Cl.

CPC ..... *A45F 4/02* (2013.01); *A45C 11/20* (2013.01); *A45F 3/04* (2013.01); *A63B 47/00* (2013.01); *A63B 63/00* (2013.01); *A45C 2003/007* (2013.01); *A45F 2003/003* (2013.01); *A63B 2210/54* (2013.01); *A63B 2225/68* (2013.01)

(58) Field of Classification Search

CPC .. A45F 2004/006; A45F 2004/02; A45F 3/04; A45F 2003/007; A63B 47/00; A63B 2225/68; A45C 11/20; A45C 2003/007

USPC ..... 224/153, 581

See application file for complete search history.

(56) References Cited

U.S. PATENT DOCUMENTS

| | | | | | |
|---|---|---|---|---|---|
| 4,790,463 | A * | 12/1988 | Hansen | A45F 3/04 | 114/315 |
| 4,883,207 | A * | 11/1989 | McArthur | A45F 3/04 | 190/113 |
| 5,012,964 | A * | 5/1991 | Falletta | B63C 11/26 | 224/153 |
| 5,301,705 | A * | 4/1994 | Zheng | A63B 9/00 | 135/125 |
| 5,560,385 | A * | 10/1996 | Zheng | A63B 9/00 | 135/117 |

(Continued)

*Primary Examiner* — Brian D Nash

(57) ABSTRACT

A multifunctional goal for ball sports is a target for sporting games which also allows for the transportation of small effects, a sporting ball, food, and drinks. The multifunctional goal includes a bottom base, a lateral wall, a top lid, a goal aperture, and a goal netting. The bottom base, the lateral wall, and the top lid delineate a storage volume to transport times and house a sporting ball. The goal aperture traverses through the lateral wall to provide a target for the sporting game. The goal netting is perimetrically connected to the goal aperture in order to partition the storage volume for a sporting ball to be stored within the partition. The bottom base includes an insulated top, an insulated lateral wall, and an insulated base in order to reduce the rate of heat transfer to the cold food or drinks stored within the bottom base.

19 Claims, 7 Drawing Sheets

(56) References Cited

U.S. PATENT DOCUMENTS

D379,209 S * 5/1997 Coddington, Jr. ..... D21/419
5,680,973 A * 10/1997 Vulpitta ..... A45C 9/00 108/43
5,722,446 A * 3/1998 Zheng ..... A63B 63/08 135/116
6,006,772 A * 12/1999 Zheng ..... A63B 9/00 135/117
6,021,794 A * 2/2000 Guerra ..... E04H 15/001 135/121
6,039,474 A * 3/2000 DeChant ..... A45C 3/00 190/109
6,305,396 B1 * 10/2001 Zheng ..... A63B 9/00 135/115
6,561,329 B2 * 5/2003 Stobbs, II ..... A45C 3/00 190/107
6,688,470 B2 * 2/2004 Dege ..... A45C 11/20 206/545
6,830,170 B2 * 12/2004 Abel ..... A01M 31/006 190/107
6,926,020 B2 * 8/2005 Zheng ..... A63B 9/00 135/117
7,021,460 B2 * 4/2006 Roeback ..... A63B 47/00 206/315.9
7,854,688 B2 * 12/2010 Zheng ..... A63B 9/00 190/107
8,021,272 B2 * 9/2011 Zheng ..... A63B 9/00 482/148
8,695,859 B1 * 4/2014 Stalker ..... A45F 3/04 135/901
2002/0030052 A1 * 3/2002 Joo-Tai ..... A45C 7/0077 220/9.2
2002/0100777 A1 * 8/2002 Zheng ..... A45C 15/00 224/153
2003/0168360 A1 * 9/2003 Zheng ..... A63B 63/08 206/216
2008/0214334 A1 * 9/2008 Zheng ..... A63B 63/08 473/485

* cited by examiner

MULTIFUNCTIONAL GOAL FOR BALL SPORTS, COOLER, AND BACKPACK

The current application claims a priority to the U.S. Provisional Patent application Ser. No. 62/093,764 filed on Dec. 18, 2014.

FIELD OF THE INVENTION

The present invention relates generally to backpacks and other portable bags. More particularly, the present invention relates to a multi-compartmented bag that functions as a goal or target for ball sports and games, an insulated cooler for food and beverages, and a backpack, inter alia.

BACKGROUND OF THE INVENTION

Backpacks and coolers are well known in the related art. Backpacks are commonly used by students and hikers, but primarily provide a convenient, comfortable hands free means of transporting items in any situation. Coolers are thermally insulated containers particularly used to keep beverages and perishable food items cold during outdoor recreational activities such as picnics, cookouts, going to the beach, tailgate parties, or the like. Typically, handles are provided on the lid or sides of the cooler so that it may be carried to and from a social gathering. However, this arrangement suffers from the disadvantage of being unwieldy and difficult for one person to carry comfortably. Furthermore, coolers are conventionally designed with one compartment and are dedicated to storing food and beverages. It is common that when going to the beach or other social gatherings, another bag will be needed to carry other necessary items, such as phones, keys, and wallets, and/or entertainment items, such as balls for games and sports.

It is the primary objective of the present invention to provide a versatile multi-compartmented bag that functions as a goal or target for ball sports and games, an insulated cooler for food and beverages, and a backpack, inter alia. These and other objects and advantages of the present invention will become apparent through the following detailed description in conjunction with the appended drawings.

DETAIL DESCRIPTIONS OF THE INVENTION

All illustrations of the drawings are for the purpose of describing selected versions of the present invention and are not intended to limit the scope of the present invention.

The present invention is a multifunctional goal for ball sports, cooler, and backpack. The present invention is a compartmentalized bag which allows a user to store personal effects, sporting balls, food and drinks for easy transportation. Further, the present invention is a goal for sporting balls, such as footballs, soccer balls, volleyballs, etc. The user is able to set up at least one of the present invention in a localized area in order to play or compete in a game related to a chosen sporting ball.

Figure 1:
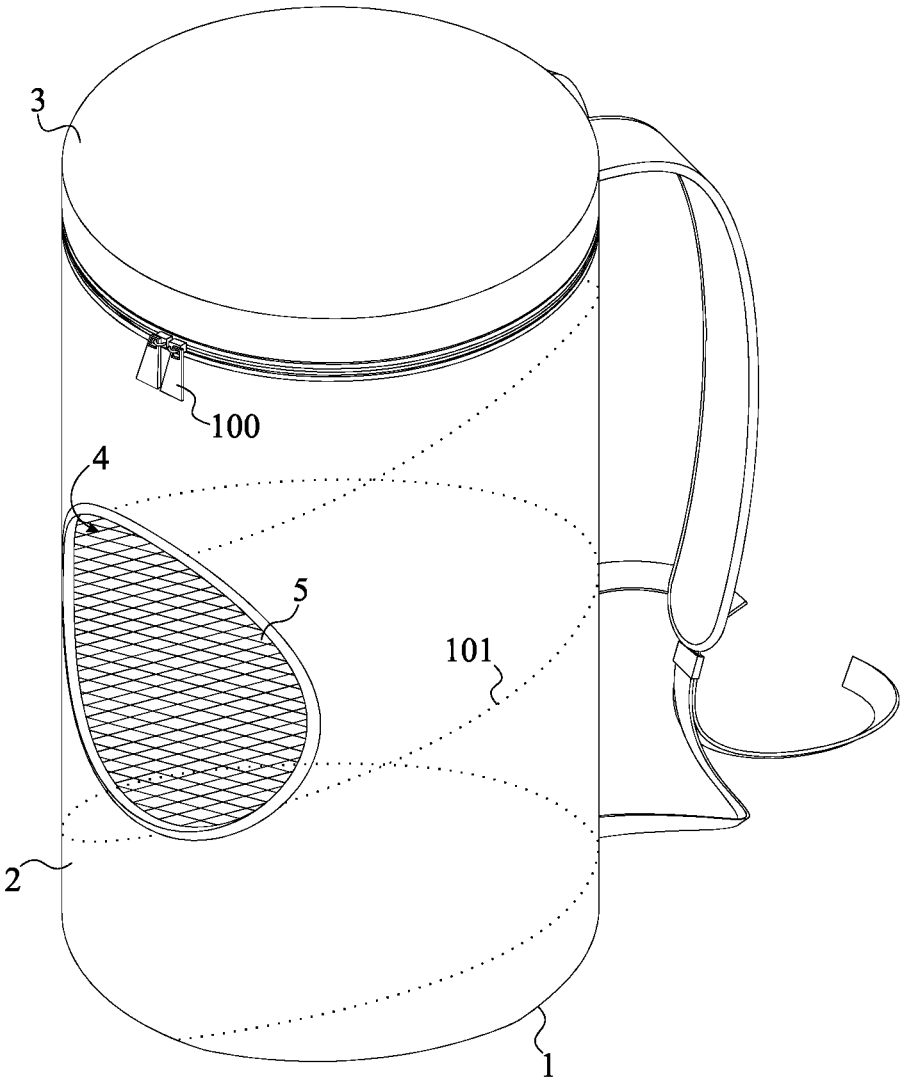
FIG. 1 is a perspective view of the simplest embodiment of the present invention.
Figure 7:
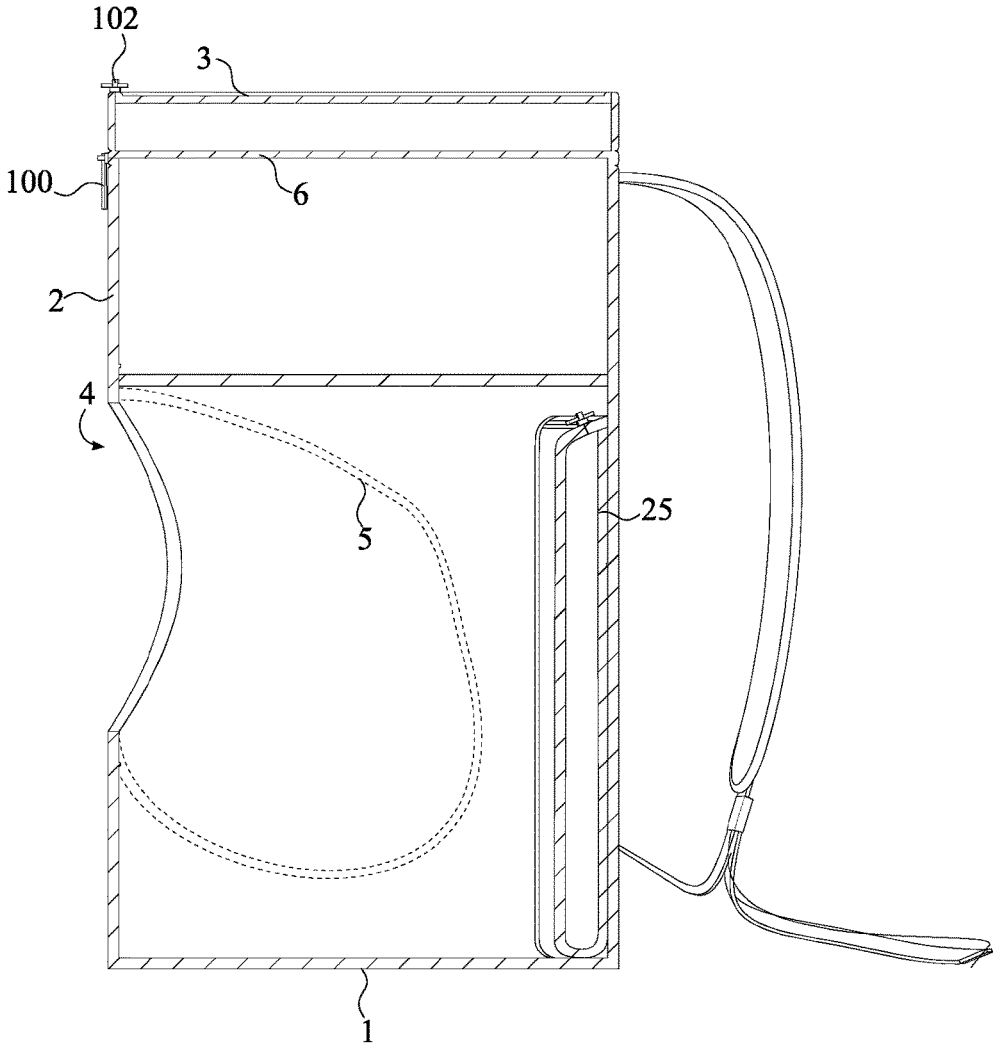
FIG. 7 is a vertical cross section of the present invention taken along line 7-7 in FIG. 3, wherein line 7-7 is through center of the goal aperture.

In accordance to FIG. 1, the present invention comprises a bottom base 1, a lateral wall 2, a top lid 3, a goal aperture 4, and a goal netting 5. The bottom base 1 provides the present invention with a base to support items that are stored within the present invention. The lateral wall 2 and the bottom base 1 delineate a storage volume that retains the stored items within the present invention. Thus, the lateral wall 2 is perimetrically and adjacently attached to the bottom base 1. The top lid 3 is a flap which encloses the storage volume while allowing the user to access to the storage volume. The top lid 3 is hingedly connected to the lateral wall 2, opposite the bottom base 1. In accordance to the preferred embodiment of the present invention, the top lid 3 perimetrically engages the lateral wall 2 by a zipper 100 in order to close off the storage volume. The goal aperture 4 is a hole through the lateral wall 2 which allows for a sporting ball to pass through. The goal aperture 4 traverses through the lateral wall 2. The goal netting 5 provides a flexible pocket to hold and catch a sporting ball as a user places or tosses the sporting ball through the goal aperture 4. The goal netting 5 is perimetrically connected to the goal aperture 4 and positioned within the lateral wall 2, as shown in FIG. 1 and FIG. 7, such that the sporting ball is able to be contained by the goal netting 5 within the storage volume. Positioning the sporting ball within the goal netting 5 allows for easy transportation for the sporting ball, as well as partitioning the storage volume to allow for personal effects, food, drinks, etc. to be placed within the storage volume about the goal netting 5.

In accordance to the preferred embodiment, the lateral wall 2 comprises a helical wire support 101, which can be seen in FIG. 1. The helical wire support 101 is integrated into and around the lateral wall 2. The helical wire support 101 provides a spring like quality to the lateral wall 2 in order to maintain a cylindrical shape when the lateral wall 2 is unrestricted.

Figure 2:
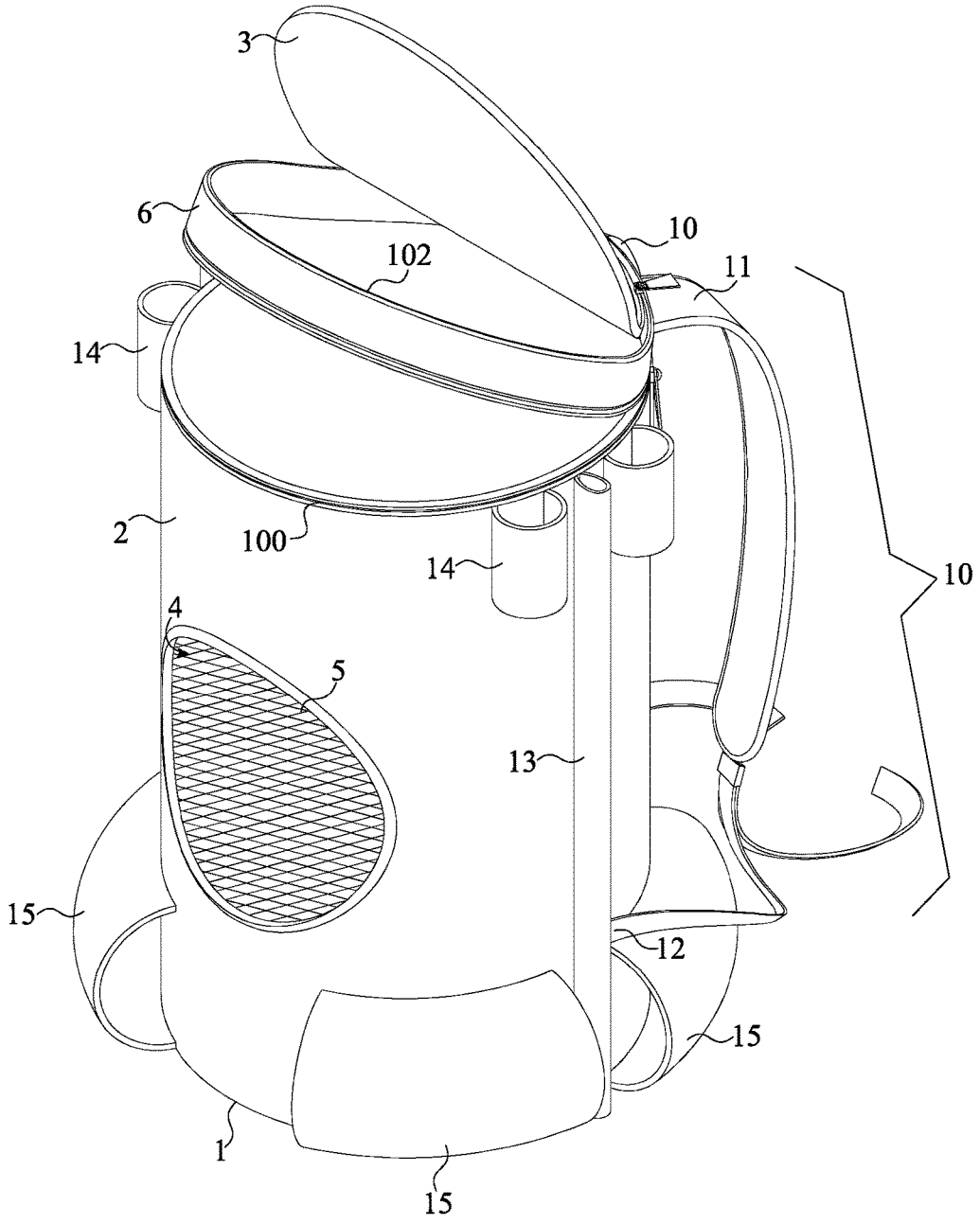
FIG. 2 is a perspective view of the present invention including flotation panels, a top divider, at least one cup holders, and at least one tubular sleeve.

In some embodiments of the present invention, the present invention comprises a top divider 6, in accordance to FIG. 2 and FIG. 7. The top divider 6 allows for an additional partition of the storage volume adjacent to the top lid 3 to store keys, phones, wallets or other small items. The top divider 6 is hingedly connected to the lateral wall 2, opposite to the goal aperture 4. The top lid 3 is hingedly connected to the lateral wall 2 by the top divider 6. This configuration allows for the top lid 3 and the top divider 6 to be folded away from the goal aperture 4 to allow access to the storage volume or allow for a second goal aperture 4 to be accessible for implementation of the present invention as a sporting target. The top divider 6 is preferred to be perimetrically engaged to both the lateral wall 2 and the top lid 3 by a zipper 102. The zipper 102 allows for the storage volume portioned between the top lid 3 and the top divider 6 and the storage volume between the top divider 6, the lateral wall 2, and the bottom base 1 are easily accessible while allowing the contents within the storage volume to be secured.

Figure 5:
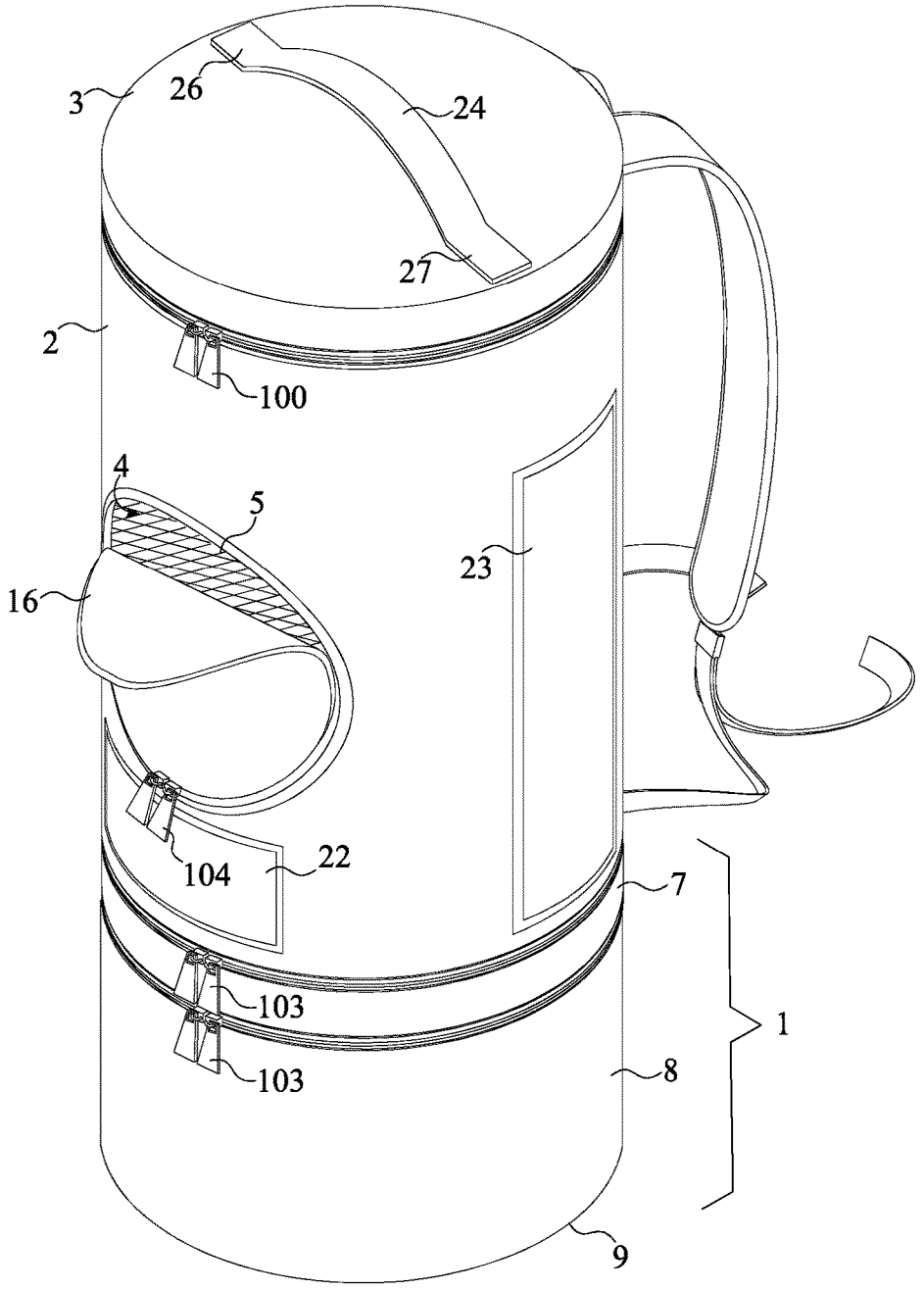
FIG. 5 is a perspective view of the present invention including a goal flap, a top handle, a front pocket, at least one side pocket, an insulated top, an insulated lateral wall, and an insulated base.

In some embodiments of the present invention, the bottom base 1 comprises an insulated top 7, an insulated lateral wall 8, and an insulated base 9, as detailed in FIG. 5. The insulated top 7, the insulated lateral wall 8, and the insulated base 9 delineate an insulated volume which cold beverages and food can be placed to reduce heat transfer to the cold beverages and food. In other words, the insulated top 7, the insulated lateral wall 8, and the insulated base 9 form a cooler to store cold beverages and food. The insulated top 7 is perimetrically and adjacently attached to the lateral wall 2. The insulated lateral wall 8 is hingedly connected to the insulated top 7. The insulated top 7 is perimetrically engaged with both the lateral wall 2 and the insulated lateral wall 8 by a zipper 103. This configuration allows for the insulated volume to be detached from the lateral wall 2 if necessary as well as access to the insulated volume when the insulated top 7 is attached to the lateral wall 2. The insulated base 9 encloses the insulated volume from the bottom as the insulated base 9 is perimetrically and adjacently connected to the lateral wall 2.

Figure 3:
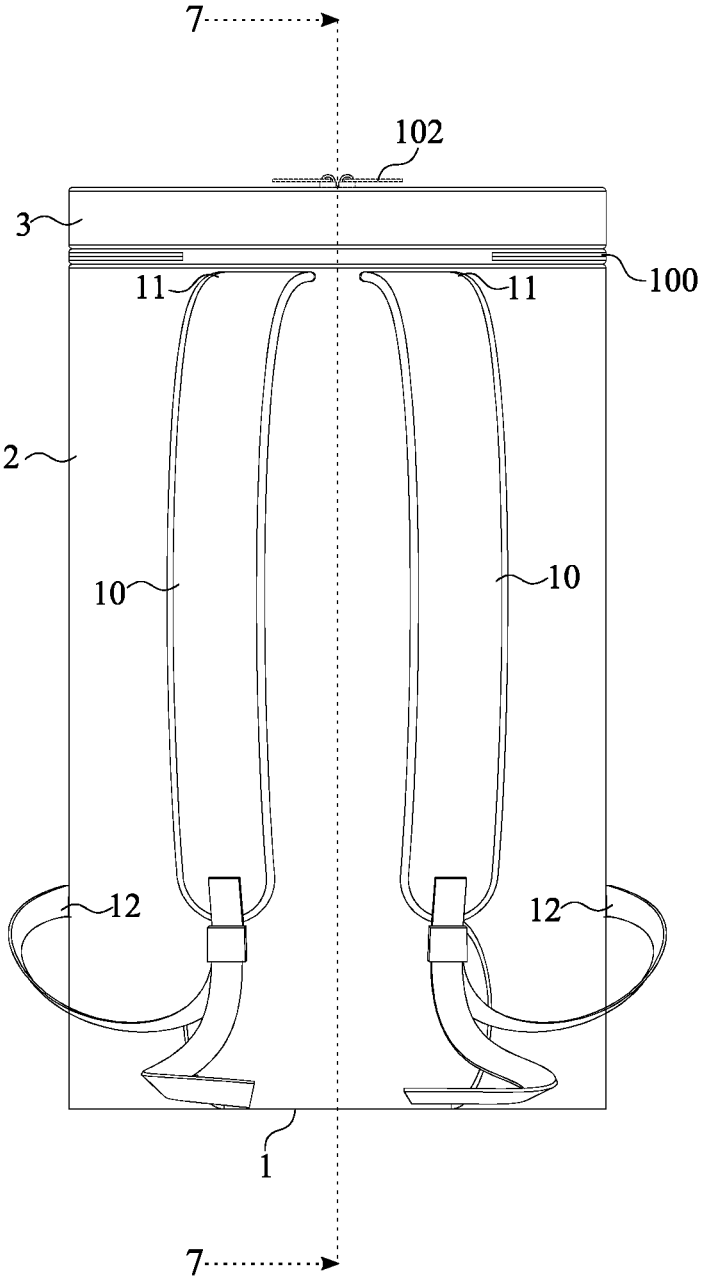
FIG. 3 is a rear view of the present invention detailing the pair of shoulder straps.

Further in accordance to the preferred embodiment, FIG. 2, and FIG. 3, the present invention comprises a pair of adjustable shoulder straps 10. The pair of adjustable shoulder straps 10 allows the user to support the present invention on the user's back and shoulders as the user's arms are placed through the pair of adjustable shoulder straps 10 and the lateral wall 2 positioned on the user's back. The pair of adjustable shoulder straps 10 is able to cinch according to a user's preference around the user's shoulders to provide sufficient support for the present invention. The pair of adjustable shoulder straps 10 is positioned opposite to the goal aperture 4 about the lateral wall 8 such that the pair of adjustable shoulder straps 10 do not interfere with the implementation of the present invention. The pair of adjustable shoulder straps 10 is offset from each other about the lateral wall 2 in order for the pair of adjustable shoulder straps 10 to be comfortably positioned about the user's neck and around the user's shoulders. The pair of adjustable shoulder straps 10 each comprise a first strap end 11 and a second strap end 12. The first strap end 11 is connected to the lateral wall 2 adjacent to the top lid 3 and the second strap end 12 is connected to the lateral wall 2 adjacent to the bottom base 1 to sufficiently mount the pair of adjustable shoulder straps 10 onto the lateral wall 2.

In some embodiments of the present invention, the present invention comprises at least one tubular sleeve 13, exemplified in FIG. 2. The at least one tubular sleeve 13 is able to receive umbrella poles, tent poles, or similar anchors to secure the present invention to a ground surface. The at least one tubular sleeve 13 is externally connected along the lateral wall 2 and positioned perpendicular to the goal aperture 4 on the lateral wall 2. This configuration allows for the present invention to be positioned upright as an umbrella pole, for example, is positioned through the at least one tubular sleeve 13 and into a ground surface. The tubular sleeve 13 can also be used to store elongated sporting objects such as a baseball bat and lacrosse stick.

In some embodiments of the present invention, the present invention comprises at least one cup holder 14, as shown in FIG. 2. The at least one cup holder 14 allows for a beverage container to be supported by the present invention to secure the beverage container to the present invention. The at least one cup holder 14 is mounted onto the lateral wall 2 and positioned adjacent to the top lid 3. The at least one cup holder 14 is a cylindrical enclosure comprising an open cup holder end. The open cup holder end is positioned adjacent to the top lid 3 such that a beverage container can be placed through the open cup holder end into the at least one cup holder 14. The at least one cup holder 14 further comprises a cinching cord and an adjustable locking mechanism in order to secure a beverage container onto the present invention. The cinching cord is perimetrically integrated into at least one cup holder 14 about the open cup holder end. The adjustable locking mechanism engages the cinching cord adjacent to the open cup holder end such that the cinching cord is able to slide through the adjustable locking mechanism to restrict the diameter of the at least one cup holder 14 at the open cup holder end.

In still other embodiments of the present invention, the present invention comprises a plurality of floatation panels 15, detailed in FIG. 2. The plurality of floatation panels 15 allows the present invention to float upright, such that the present invention is able to be implemented in a pool or beach. The plurality of floatation panels 15 is preferred to be a series of panels which allow for a pool noodle or similar foam tubes to be positioned between each of the plurality of floatation panels 15 and the lateral wall 2; however, the plurality of floatation panels 15 may also be an inflatable bladder, integrated low density material, or other application. The plurality of floatation panels 15 is mounted onto the lateral wall 2 and positioned adjacent to the bottom base 1. The plurality of floatation panels 15 is evenly distributed about the lateral wall 2 in order to provide a buoyant force around the present invention in order to support the present invention on a fluid surface.

In still other embodiments of the present invention, the present invention comprises a goal flap 16, in accordance to FIG. 5. The goal flap 16 allows a sporting ball to be secured within the storage volume defined by goal netting 5 and the goal aperture 4. The goal flap 16 is hingedly and externally connected to the lateral wall 2, adjacent to the goal aperture 4. The goal flap 16 is preferred to be perimetrically engaged with the goal aperture 4 by a zipper 104. Thus, the goal flap 16 is able to be selectively secured to the lateral wall 2 about the goal aperture 4 in order to retain a sporting ball as well as expose the goal aperture 4 to be a target for sporting games.

Figure 6:
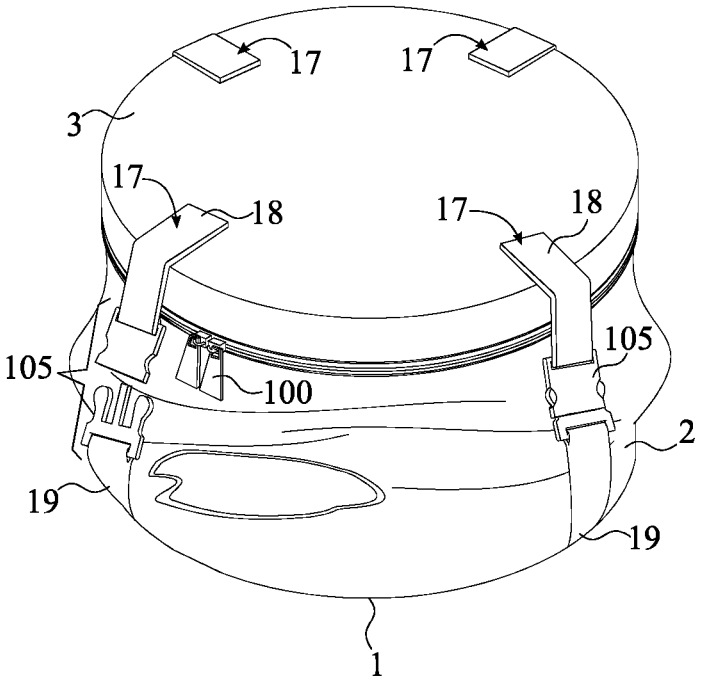
FIG. 6 is a perspective view of the present invention in a collapsed configuration.

In accordance to some embodiments of the present invention, the present invention comprises a plurality of buckling straps 17, which can be seen in FIG. 6. The plurality of buckling straps 17 secures the present invention in a collapsed configuration for storage. Each of the plurality of buckling straps 17 is evenly distributed about the lateral wall 2 to adequately secure the present invention in the collapsed configuration. Each of the plurality of buckling straps 17 comprises a top fastening strap 18 and a bottom fastening strap 19. The top fastening strap 18 is connected to the top lid 3. The bottom fastening strap 19 is connected to the bottom base 1, opposite to the lateral wall 2. The top fastening strap 18 is coupled with the bottom fastening strap 19 by a buckle 105, in order to allow the user to selectively configure the present invention into an operative configuration or the collapsed configuration for storage.

As detailed in FIG. 5, the present invention further comprises a front pocket 22 and at least one side pocket 23 in some embodiments of the present invention to provide additional storage space for small items and personal effects. The front pocket 22 is integrated into the lateral wall 2 and is positioned between the goal aperture 4 and the bottom base 1. The at least one side pocket 23 is similarly integrated into the lateral wall 2. The at least one side pocket 23 is radially offset from the goal aperture 4 about the lateral wall 2. The at least one side pocket 23 is preferably is made of an elastic mesh material and is sized to accommodate footwear such as sandals, sports cleats, and shoes. The positioning of the front pocket 22 and the at least one side pocket 23 allow for additional storage space which does not interfere with the implementation of the present invention as a sporting goal.

In some embodiments of the present invention, the present invention comprises a top handle 24, as shown in FIG. 5. The top handle 24 allows the user to quickly grasp the present invention for transportation or to manipulate the top lid 3. The top handle 24 comprises a first handle end 26 and a second handle end 27. The first handle end 26 is connected to the top lid 3. The second handle end 27 is similarly connected to the top lid 3. The first handle end 26 is opposite to the second handle end 27 across the top lid 3 in order to distribute the force applied to the top lid 3 through the top handle 24.

Figure 4:
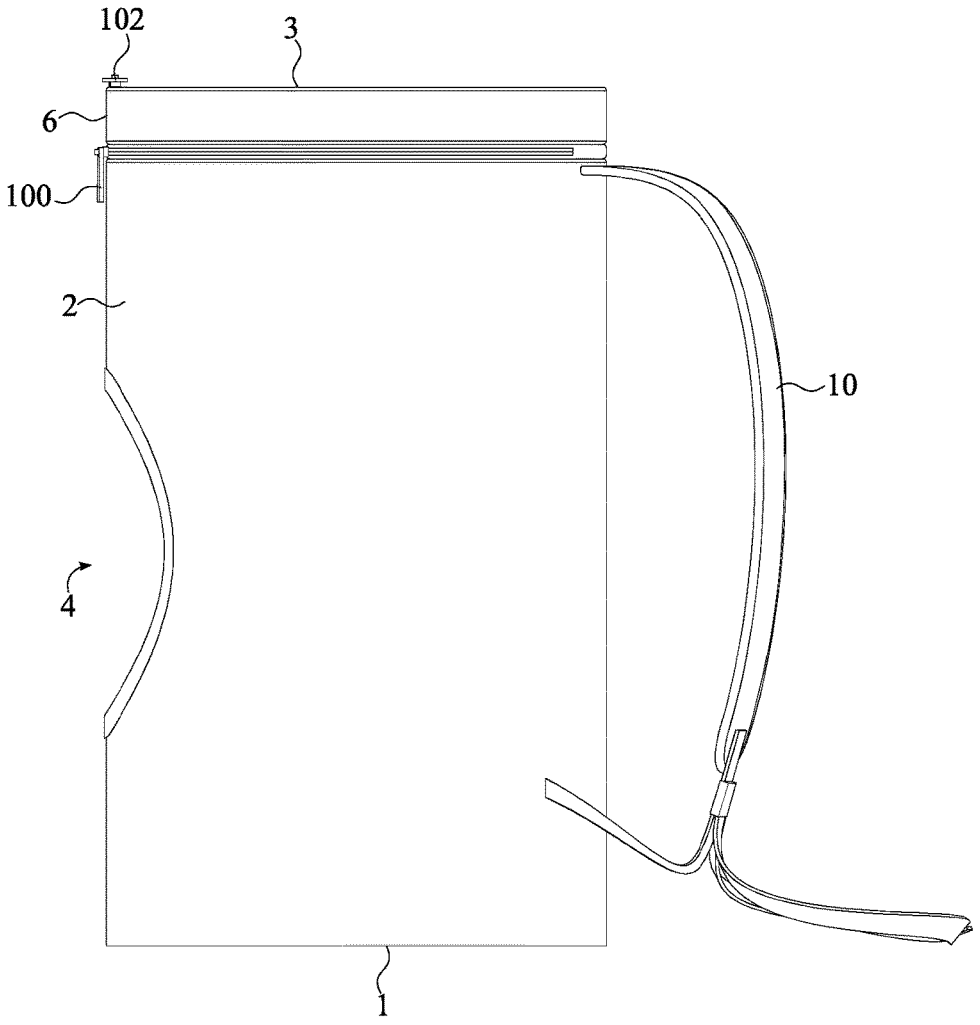
FIG. 4 is a side view of the present invention exemplifying the vertical support.

In still other embodiments of the present invention, the present invention comprises a vertical support 25, in accordance to FIG. 4 and FIG. 7. The vertical support 25 is a modular support for the lateral wall 2. The vertical support 25 is externally attached along the lateral wall 2 and positioned opposite to the goal aperture 4 about the lateral wall 2. In this embodiment of the present invention detailed in FIG. 4 and in conjunction with the pair of shoulder straps 10, the vertical support 25 acts as back support to maintain the structure of the lateral wall 2 and prevent the contents of the storage volume from becoming a discomfort to the user wearing the present invention. In accordance to FIG. 7, the vertical support 25 is able to be detached externally from the lateral wall 2, internally attached along the lateral wall 2 and positioned opposite to the goal aperture 4 about the lateral wall 2. Thus, the vertical support 25 provides structural support to the lateral wall 2 while the present invention is implemented as a sporting goal.

For implementation as a goal apparatus, at least two of the present invention are set up by the participants disconnecting the top fastener 20 from the bottom fastener 21 for the at least two of the present invention to allow the lateral wall 2 of each to expand to form. The participants then weigh the present invention by detaching the bottom base 1 and placing the bottom base 1 within the lateral wall 2, placing weight on the bottom base 1, or anchoring the present invention to the ground in order to stabilize the present invention. The at least two of the present invention are oriented towards a centralized point and approximately three and a half yards from the centralized point. The goal flap 16 is then disengaged to expose the goal aperture 4.

Once set up has been complete, it is preferred that the participants divide into teams of one, two, or four for each of the at least two of the present invention. Teams then further evenly divided to position participants at each of the at least two of the present invention. Once the teams have decided which team will go first, each teammate will kick, throw or serve the sporting ball to an opposite present invention of the at least two of the present invention. The objective of the sporting game is to hit, throw, serve, or have a teammate deflect the sporting ball into the goal aperture 4 or into the lateral wall 2 opposite to the bottom base 1. Once each participant for a team has a chance to hit, throw or serve the sporting ball towards an opposite present invention, the process repeats for each participant of the other team.

In order to win the sporting game, a team needs to acquire exactly twenty-one points. If a team exceeds twenty-one points, the team's points will be reset to fifteen. Points are acquired by landing the sporting ball into the goal aperture 4 or the storage volume. The point value are scored on the type of sporting ball, difficulty for which aperture the sporting ball lands into, and whether the sporting ball is deflected into the present invention by a teammate. The point values will be decided by the participants before the sporting game begins.

Although the invention has been explained in relation to its preferred embodiment, it is to be understood that many other possible modifications and variations can be made without departing from the spirit and scope of the invention as hereinafter claimed.

What is claimed is:

1. A multifunctional goal for ball sports comprising:
- a bottom base;
- a lateral wall;
- a top lid;
- a storage volume;
- a goal aperture;
- a goal netting;
- the lateral wall being perimetrically and adjacently attached to the bottom base;
- the top lid being hingedly connected to the lateral wall, opposite to the bottom base;
- the storage volume being delineated by the bottom base, the lateral wall and the top lid;
- the goal aperture traversing through the lateral wall;
- the goal aperture being positioned between the bottom base and the top lid;
- the goal netting being perimetrically connected to a periphery of the goal aperture; and
- the goal netting being positioned within the storage volume.

2. The multifunctional goal for ball sports, as claimed in claim 1, comprising:
- the top lid perimetrically engaging the lateral wall by a zipper.

3. The multifunctional goal for ball sports, as claimed in claim 1, comprising:
- a top divider;
- the top divider being hingedly connected to the lateral wall, opposite to the goal aperture; and
- the top lid being hingedly connected to the lateral wall by the top divider.

4. The multifunctional goal for ball sports, as claimed in claim 3, comprising:
- the top divider perimetrically engaging both the lateral wall and the top lid by a zipper.

5. The multifunctional goal for ball sports, as claimed in claim 1, comprising:
- the bottom base comprising an insulated top, an insulated lateral wall, and an insulated base;
- the insulated top being perimetrically and adjacently attached to the lateral wall;
- the insulated lateral wall being hingedly connected to the insulated top; and
- the insulated base being perimetrically and adjacently connected to the insulated lateral wall.

6. The multifunctional goal for ball sports, as claimed in claim 5, comprising:
- the insulated top being perimetrically engaged with both the lateral wall and the insulated lateral wall by a zipper.

7. The multifunctional goal for ball sports, as claimed in claim 1, comprising:
- a pair of adjustable shoulder straps;
- the pair of adjustable shoulder straps each comprise a first strap end and a second strap end;
- the pair of adjustable shoulder straps being positioned opposite to the goal aperture about the lateral wall;

the pair of adjustable shoulder straps being offset from each other about the lateral wall;

the first strap end being connected to the lateral wall adjacent to the top lid; and the second strap end being connected to the lateral wall adjacent to the bottom base.

8. The multifunctional goal for ball sports, as claimed in claim 1, comprising:

at least one tubular sleeve;

the at least one tubular sleeve being externally connected along the lateral wall; and the at least one tubular sleeve being positioned perpendicular to the goal aperture on the lateral wall.

9. The multifunctional goal for ball sports, as claimed in claim 1, comprising:

at least one cup holder;

the at least one cup holder being mounted onto the lateral wall; and the at least one cup holder being positioned adjacent to the top lid.

10. The multifunctional goal for ball sports, as claimed in claim 1, comprising:

a plurality of floatation panels;

the plurality of floatation panels being mounted onto the lateral wall;

the plurality of floatation panels being positioned adjacent to the bottom base; and the plurality of floatation panels being evenly distributed about the lateral wall.

11. The multifunctional goal for ball sports, as claimed in claim 1, comprising:

a goal flap; and the goal flap being hingedly and externally connected to the lateral wall, adjacent to the goal aperture.

12. The multifunctional goal for ball sports, as claimed in claim 11, comprising:

the goal flap being perimetrically engaged with goal aperture by a zipper.

13. The multifunctional goal for ball sports, as claimed in claim 1, comprising:

a plurality of buckling straps;

each of the plurality of buckling straps comprising a top fastening strap, a bottom fastening strap, a top fastener, and a bottom fastener;

each of the plurality of buckling straps being evenly distributed about the lateral wall;

the top fastening strap being connected onto the top lid;

the bottom fastening strap being connected onto the bottom base; and the top fastener being coupled with the bottom fastener by a buckle.

14. The multifunctional goal for ball sports, as claimed in claim 1, comprising:

a front pocket;

the front pocket being integrated into the lateral wall; and the front pocket being positioned between the goal aperture and the bottom base.

15. The multifunctional goal for ball sports, as claimed in claim 1, comprising:

at least one side pocket;

the at least one side pocket being integrated into the lateral wall; and the at least one side pocket being radially offset from the goal aperture about the lateral wall.

16. The multifunctional goal for ball sports, as claimed in claim 1, comprising:

a top handle;

the top handle comprising a first handle end and a second handle end;

the first handle end being connected to the top lid;

the second handle end being connected to the top lid; and the first handle end being opposite to the second handle end across the top lid.

17. The multifunctional goal for ball sports, as claimed in claim 1, comprising:

a vertical support;

the vertical support being externally attached along the lateral wall; and the vertical support being positioned opposite to the goal aperture about the lateral wall.

18. The multifunctional goal for ball sports, as claimed in claim 1, comprising:

a vertical support;

the vertical support being internally attached along the lateral wall; and the vertical support being positioned opposite to the goal aperture about the lateral wall.

19. The multifunctional goal for ball sports, as claimed in claim 1, comprising:

a helical wire support; and the helical wire support being integrated into and around the lateral wall.

* * * * *